US009295877B2

(12) United States Patent
Andrews

(10) Patent No.: US 9,295,877 B2
(45) Date of Patent: Mar. 29, 2016

(54) STRETCHING DEVICE

(76) Inventor: Stuart John Andrews, Curtain (AU)

( * ) Notice: Subject to any disclaimer, the term of this patent is extended or adjusted under 35 U.S.C. 154(b) by 83 days.

(21) Appl. No.: 13/812,032

(22) PCT Filed: Aug. 3, 2011

(86) PCT No.: PCT/AU2011/000975

§ 371 (c)(1),
(2), (4) Date: Jan. 24, 2013

(87) PCT Pub. No.: WO2012/016278

PCT Pub. Date: Feb. 9, 2012

(65) Prior Publication Data

US 2013/0123069 A1 May 16, 2013

(30) Foreign Application Priority Data

Aug. 3, 2010 (AU) ..... 2010903462

(51) Int. Cl.

| | |
|---|---|
| ***A63B 24/00*** | (2006.01) |
| ***A63B 21/00*** | (2006.01) |
| ***A63B 21/008*** | (2006.01) |
| ***A63B 21/22*** | (2006.01) |
| ***A63B 23/04*** | (2006.01) |
| ***A63B 23/12*** | (2006.01) |
| ***A63B 71/06*** | (2006.01) |

(52) U.S. Cl.

CPC ..... *A63B 24/00* (2013.01); *A63B 21/00072* (2013.01); *A63B 21/0087* (2013.01); *A63B 21/00181* (2013.01); *A63B 21/156* (2013.01); *A63B 21/158* (2013.01); *A63B 21/22* (2013.01); *A63B 21/4035* (2015.10); *A63B 23/04* (2013.01); *A63B 23/1254* (2013.01); *A63B 71/0619* (2013.01); *A63B 2024/0093* (2013.01); *A63B 2071/065* (2013.01)

(58) Field of Classification Search

CPC ..... A63B 24/00; A63B 21/00181; A63B 21/0087; A63B 21/156; A63B 21/158; A63B 21/22; A63B 21/00072; A63B 21/4032; A63B 23/04; A63B 23/1254; A63B 71/0619; A63B 2024/0093; A63B 1071/065

USPC ..... 482/1–9, 900–902; 434/247

See application file for complete search history.

(56) References Cited

U.S. PATENT DOCUMENTS

| | | | | |
|---|---|---|---|---|
| 5,575,744 | A * | 11/1996 | Jones | A63B 21/062 482/136 |
| 6,059,576 | A * | 5/2000 | Brann | 434/247 |
| 6,146,312 | A * | 11/2000 | Sclichter | 482/4 |
| 6,358,188 | B1 * | 3/2002 | Ben-Yehuda | A63B 24/00 482/8 |
| 7,648,446 | B2 | 1/2010 | Chiles et al. | |
| 7,794,359 | B1 * | 9/2010 | Lannon | A63B 21/062 482/1 |
| 2002/0183655 | A1 * | 12/2002 | Zhang | 600/587 |
| 2006/0293156 | A1 * | 12/2006 | Trees | 482/148 |

* cited by examiner

*Primary Examiner* — Glenn Richman

(74) *Attorney, Agent, or Firm* — Kagan Binder, PLLC

(57) ABSTRACT

A user-actuated stretching device (10) activates an alarm and/or a controller (48) in response to a stretch velocity condition or stretch load condition being detected. Exemplary stretch velocity conditions may be a detected drop in stretch velocity and/or a detected excessive stretch velocity. The alarm may be visual, audible or tactile. The controller preferably takes the form of a solenoid (48) which can lock a hydraulic damper (46) in response to a stretching velocity condition being detected. The device optimizes stretching and reduces the risk of over-stretching and injury.

8 Claims, 7 Drawing Sheets

STRETCHING DEVICE

RELATED APPLICATION

This application claims the benefit from International Application No. PCT/AU2011/000975, which was filed on Aug. 3, 2011, which in turn claims priority to Australian Patent Application No. 2010903462, filed Aug. 3, 2010, both of which are incorporated herein by reference in their entireties.

FIELD OF THE INVENTION

This invention relates to an improved stretching device. The invention has particular utility with a user-actuated stretching device.

For illustrative purposes, the preferred embodiment of the invention will be herein described with reference to a user-actuated stretching device in which the lower body of the user (i.e. the legs) is used to stretch the upper body of the user (i.e. the shoulders). In this particular instance, the relatively large muscles of the legs are being used to stretch the relatively small muscles of the shoulder. It will, of course, be understood that the invention has utility in stretching other body parts.

BACKGROUND OF THE INVENTION

A user-actuated stretching device is known from International Patent Application PCT/AU2004/000724 (WO 2004/110565), which is hereby incorporated in its entirety via this cross-reference. PCT/AU2004/000724 (WO 2004/110565) teaches a user-actuated stretching device in which the lower body of the user (i.e. the legs) is used to stretch the upper body of the user (i.e. the shoulders).

User-actuated stretching devices are also known from U.S. Pat. No. 5,277,681 to Holt and U.S. Pat. No. 6,733,426 to Bussell. Each of these US patents teaches a stretching device for stretching the legs of the user. As they are stretching a relatively large muscle, these US patents teach the use of a linear actuator and actuating cylinder, respectively, to drive the stretching movement.

With all stretching devices there is a potential risk for the user to be injured during operation of the stretching device. This is particularly true with user-actuated stretching devices, and even more so where large muscles are being used to stretch small muscles.

SUMMARY OF INVENTION

The present invention provides a stretching device, a safety module for a stretching device, and a method of stretching according to the following claims.

Preferred features of the invention will be apparent from the dependant claims, and from the following description of the preferred embodiment.

BRIEF DESCRIPTION OF DRAWINGS

The invention will now be described in a non-limiting manner with respect to a preferred embodiment in which:—

DETAILED DESCRIPTION OF PREFERRED EMBODIMENT

Figure 1:
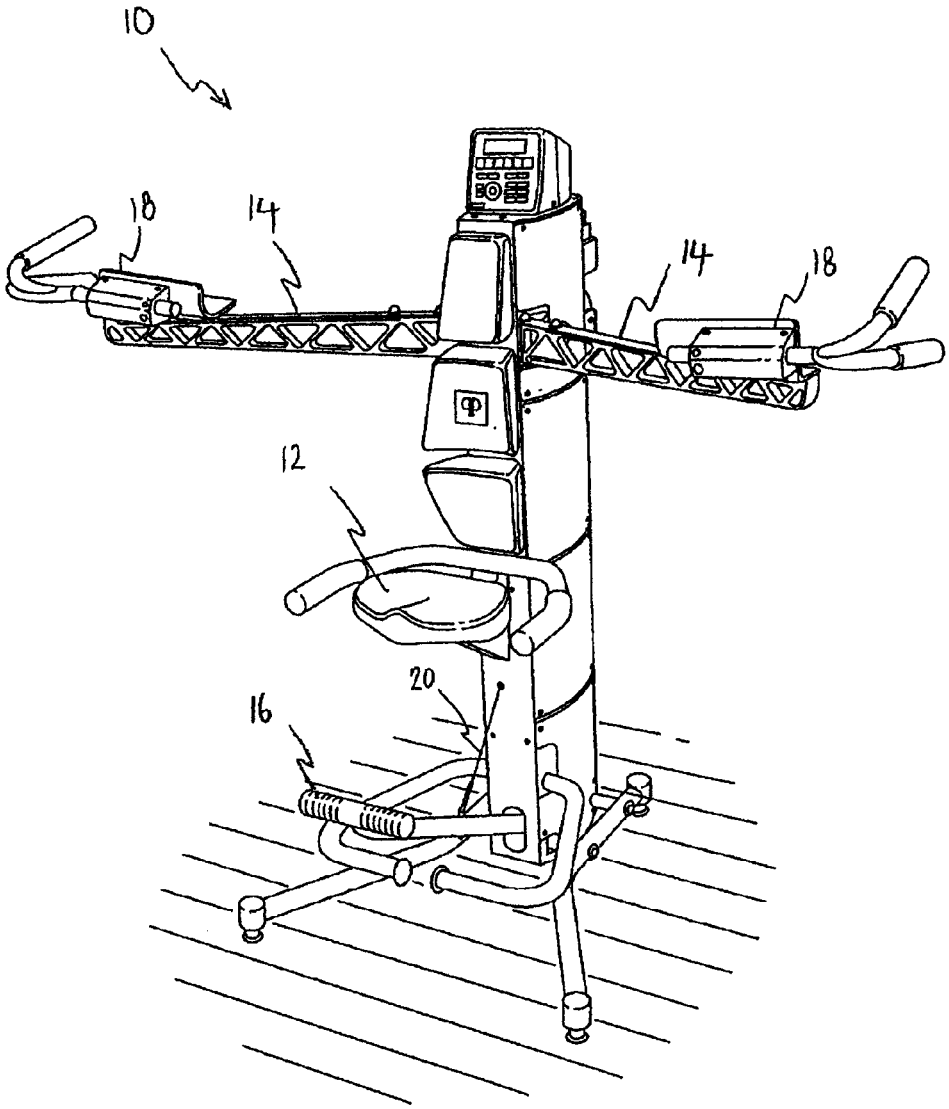
FIG. 1 is a perspective view of a stretching device according to the present invention.
Figure 2:
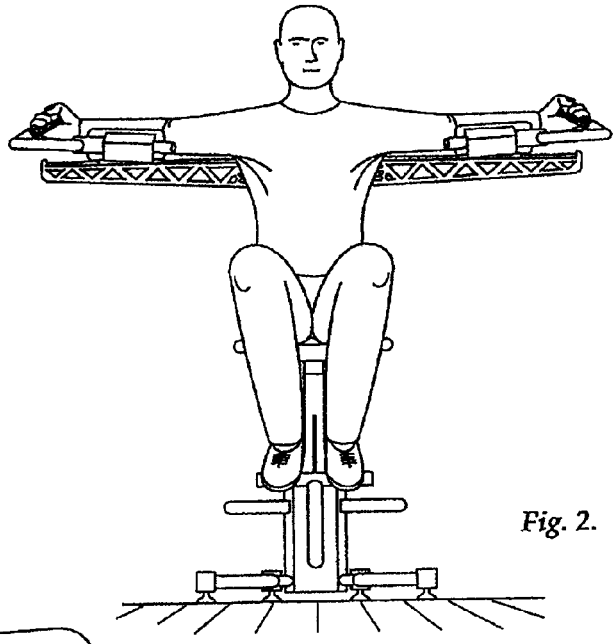
FIG. 2 is a front elevation view of the stretching device in use.
Figure 3:
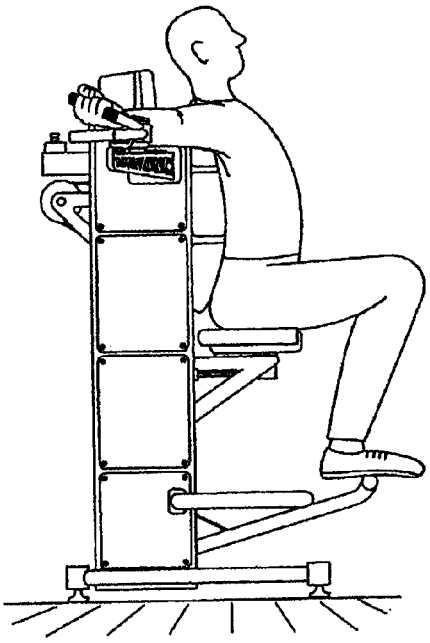
FIG. 3 is a side elevation view of the stretching device in use.
Figure 4:
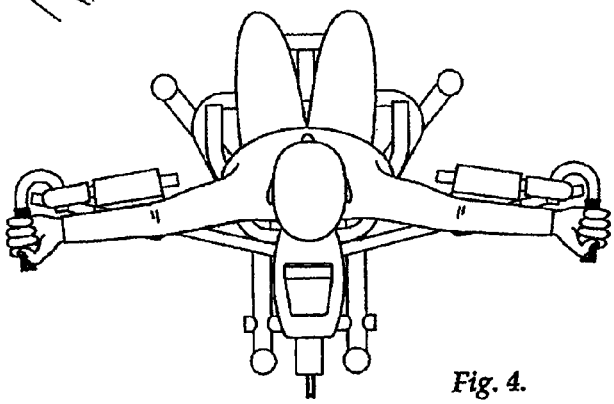
FIG. 4 is an overhead plan view of the stretching device in use.

Stretching devices can be used in an unsafe manner, particularly where the user has control of the stretching device, as opposed to placing the control of the stretching device in the hands of a trained therapist.

The most common mistakes include stretching too fast (i.e. so-called "ballistic" stretching) and/or stretching too far (i.e. exceeding the safe range of motion for the present level of flexibility of the user). Often, the former mistake causes the latter mistake (i.e. the user exceeds their range of motion because they have stretched too fast and their momentum has carried them beyond their safe range of motion). The result of over-stretching is often a muscle tear. In extreme cases, there may also be muscle/tendon injury and/or tendon/bone injury and/or ligament damage.

It is also worth mentioning that some users under-stretch. Typically this occurs where the user has had a prior injury and they are being overly protective of the prior injury. Of course, this can retard rehabilitation of the injury.

It is extremely difficult to come up with a generic solution which can be applied to a stretching device to prevent these mistakes from occurring. This is because different users will have very different levels of flexibility. Put differently, controlling the stretching device so that it has a single generic maximum range of motion for all users is not a viable solution. A single generic maximum range of motion may be totally inadequate for a more flexible user, but may still injure a less flexible user. Thus, having a generic limitation is not viable.

In addition to the significant variability of flexibility between different users, a single user's flexibility can vary greatly from session to session, or even within a single training session, as a result of warming up, massage, muscle relaxation, and general improvements in flexibility over time. For example, when rehabilitating an injury, a user may initially make rapid advances in flexibility. Conversely, a user's flexibility may decrease during a lengthy session as a result of fatigue, dehydration, or the like. This means that an individual user's safe range of motion can be quite dynamic over a relatively short period of time, and even within a single session. It follows that having a pre-set safe range of motion for each user is not a viable solution. In any event, it may be impractical to pre-set the range of motion of the stretching device for each unique user. In summary, having a personalised limitation is not viable, even when that personalised limitation is re-set periodically.

At this juncture, it is perhaps worth briefly considering what happens to a muscle as it is stretched. During the early to middle phase of the stretch movement, the muscle is not being elastically stretched. Rather, the muscle is simply being lengthened to its natural relaxed length. However, in the late phase of the stretching movement, the muscle is beginning to be elastically stretched. At this point, the tension in the muscle rapidly increases, as does the risk of injury. The art of stretching is to elastically stretch the muscle without tearing the muscle.

The inventor has observed that, as a user approaches the safe limit of their range of motion in the late phase of the stretching movement, the velocity of the user's stretch decreases concurrently with an increase in muscle tension which occurs as the muscle extends to close to its limits. Put simply, the late phase of the stretching movement is resisted by the increased muscle tension. Generally speaking, injuries occur because the user approaches the limit of their range of motion too rapidly and/or because the user ignores the muscle tension and pushes on beyond the safe limit.

The present invention flows from the above observation that the stretching velocity necessarily slows as the safe range of motion is approached and/or the muscle tension increases as the safe range of motion is approached. In particular, the safe range of motion of the user can be estimated based on the observance of (a) the reduction in velocity and/or (b) the increased load as the safe range of motion is approached. By detecting the drop in velocity and/or the increase in load as the safe limit is approached, the device can trigger an alarm to warn the user to discontinue the stretching movement, and/or the device can actively intervene and either slow or stop the stretching movement via the use of a controller, such as a brake or a lock.

The drop in velocity which triggers the alarm is preferably about 10%, but may be about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49% or 50%.

Similarly, the increase in load which triggers the alarm is preferably about 10%, but may be about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49% or 50%.

Users who are rehabilitating from a serious injury, and who will need to be more conservative, will tend to choose a smaller differential which will trigger the alarm. This will effectively make the device more sensitive.

The alarm may be visual, audible or tactile. In the case of an audible alarm, there may be an initial audible "stop" alarm, followed by an audible "countdown" which prompts the user to hold the stretch for a period of time at the stopped position, followed by an audible "release" back to the start position.

The drop in velocity which triggers the controller is preferably slightly above about 10% and is preferably 12%, but may be about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49% or 50%.

Similarly, the increase in load which triggers the controller is preferably above about 10% and is preferably about 12%, but may be about 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49% or 50%.

Activation of the controller may be followed by an audible "countdown" which prompts the user to hold the stretch for a period of time at the stopped position.

Again, users who are rehabilitating from a serious injury, and who will need to be more conservative, will tend to choose a smaller differential which triggers the operation of the controller.

In one embodiment, the alarm might be triggered by a 10% reduction in velocity and the controller might be triggered by a 12% reduction in velocity. If the user ignores the alarm at 10% and continues to attempt to extend the stretching movement, the user will continue to slow to a 12% reduction in velocity and this further reduction will trigger the intervention of the controller.

In another embodiment, the alarm and controller may be simultaneously triggered.

The above discussed drop in stretching velocity is measured relative to a (100%) benchmark velocity which is established in the early to middle phase of the stretching movement. Thus, the velocity is monitored during the early to middle phase of the stretching movement and the maximum velocity is adopted as the 100% benchmark against which subsequent reductions are measured. It is desirable for the velocity during the early to middle phase of the stretching movement to be substantially constant. This will have the benefit of preventing premature false triggering of the alarm and/or controller as a consequence of velocity variations during the early to middle phase of the stretching movement.

In order to ensure a substantially constant velocity during the early and middle phase of the stretching movement, a hydraulic damper is provided in the preferred embodiment. Of course, other types of dampers may be used. The orifice of the hydraulic damper is set such that a suitable (100%) benchmark stretching velocity is achieved in response to typical user-applied loads. The damper also ensures that it is difficult, if not impossible, for the user to achieve a dangerously high velocity during the early to middle phase of the stretching movement. Indeed, in the rare event that an unsafe high velocity is achieved despite the presence of the damper, then the alarm and/or controller may be triggered in response to the detection of this high velocity, and the user may be forced to re-start the movement.

Similarly, the (100%) benchmark load against which later loads are compared is preferably measured in the early (damped) phase of the stretching movement.

It will be appreciated that, during the early to middle phase of the stretching movement, the movement is resisted primarily by the damper (there is also a small amount of resistance from a return spring). However, during the late phase of the stretching movement, the movement is resisted by the damper and the muscle tension (and the return spring). This additional resistance from the muscle tension slows the velocity of the stretching movement and increases the load on the device, either or both of which leads to the triggering of the alarm and/or controller.

In the preferred embodiment, the damper is a mono-directional hydraulic damper. This means that the damper will resist motion in the stretching direction, but will have minimal resistance to motion in the release direction. This ensures that there is little resistance against the user if the user wishes to release the stretch and return back to the starting position. This may occur, for example, if the user experiences a muscle spasm or cramp, and consequentially wishes to rapidly release the stretch. The release movement is also assisted by a return spring.

In the preferred embodiment, the stretching device is computer controlled (via a programmable logic chip or other suitable hardware, firmware or software). Preferably, the computer has a user-interface. Prior to using the stretching device, a user may be required to punch in a security code into the user-interface. If the security code is not entered, the stretching device may be permanently braked or locked, or an alarm may sound if it is used. By this mechanism, the stretching device may only allow approved users to use the stretching device. This also ensures that the device "recognises" individual users for logging and monitoring purposes.

Preferably, the computer may have been pre-programmed with certain parameters associated with the particular user (in particular, the percentage drop-off in velocity which will trigger the alarm and/or controller for that individual user may be pre-programmed). There may be a generic maximum velocity for all users which, when exceeded, triggers the alarm and/or controller. It is noteworthy that the user's estimated safe range of motion is not a parameter that needs to be pre-programmed into the computer. Rather, this is instantaneously estimated during each and every stretching movement based on decrease in velocity and/or increase in load as discussed above.

The computer may have a logging function such that the performance of the user may be recorded for later downloading and analysis (e.g. number of reps, number of sessions, improvements in range of motion within a session or between sessions, etc). Alternatively, the stretching device may be remotely monitored in real time via a (wired or wireless) LAN or WAN.

For embodiments which operate based on increased loads, the stretching device will comprise load cell(s) which measure loads (and hence indirectly measure muscle tension) required to achieve a particular range of motion. This data may also be later downloaded and analysed or remotely monitored.

For embodiments which operate based on decreased velocity, the computer takes an input from a position detector via a wired or wireless connection. In the preferred embodiment, the detector comprises a rotary encoder which is hardwired to the computer. Of course, other types of position and velocity detectors may be used (e.g. linear encoder, laser range-finder, etc). The output of the rotary encoder is sampled by a clock in the computer (e.g. at 1,000 Hertz) and the stretch velocity is repeatedly calculated by the computer. The maximum velocity achieved in the early to middle phase of the stretching movement is recorded as a benchmark. Alternatively, the benchmark velocity may be based on multiple samples and/or some average reading during the early to middle phase of the movement.

The computer is operatively associated with the alarm and with the controller (e.g. via a wired or wireless connection). When a predetermined velocity condition is detected (e.g. the predetermined drop in velocity or the maximum velocity being exceeded) and/or a predetermined load condition is detected, then the computer activates the alarm and/or controller.

Upon each return to the relaxed or start position, the rotary encoder may be re-zeroed to ensure that there is no instrument "drift" on the position measurements. In the preferred embodiment, this is achieved via a zeroing switch which is re-set upon each return to the start position. Again, the switch may communicate with the computer via a wired or wireless connection.

In the preferred embodiment, the controller takes the form of an electrical solenoid which can be used to selectively lock the hydraulic damper and prevent further movement in the stretching direction. Again, there may be a wired or wireless connection between the computer and solenoid. Of course, other types of brakes and locks may be used. Again, it is noteworthy that the lock will not prevent movement in the release direction back towards the start position. This means that the user is not ever locked in the stretched position and can rapidly release the stretch in the event of a muscle spasm or cramp. In the event of an electrical failure, the system is fail-safe and the user can always move in the release direction, even when power to the computer and/or solenoid is lost.

In the preferred embodiment, the controller is a solenoid lock which is integrally associated with the damper. In alternative embodiments, the controller may be separate from the damper and may take the form of, for example, a disc brake, drum brake, electric (regenerator) motor, etc.

Remarkably, the present invention provides an adaptive stretching device which adjusts instantaneously to match a user's flexibility. This optimises stretching and minimises injuries.

With reference to FIGS. 1-4, the stretching device 10 includes a seat 12, a pair of pivoting swing arms 14 which swing rearwardly through a horizontal arcuate path, and a foot bar 16 which swings downwardly through a vertical arcuate path. A user sits on the seat, places their arms on the supports 18 which are mounted on the swing arms, and presses the foot bar downwardly in a leg press motion. Consequently, the user's arms are pivoted rearwardly.

Figure 5:
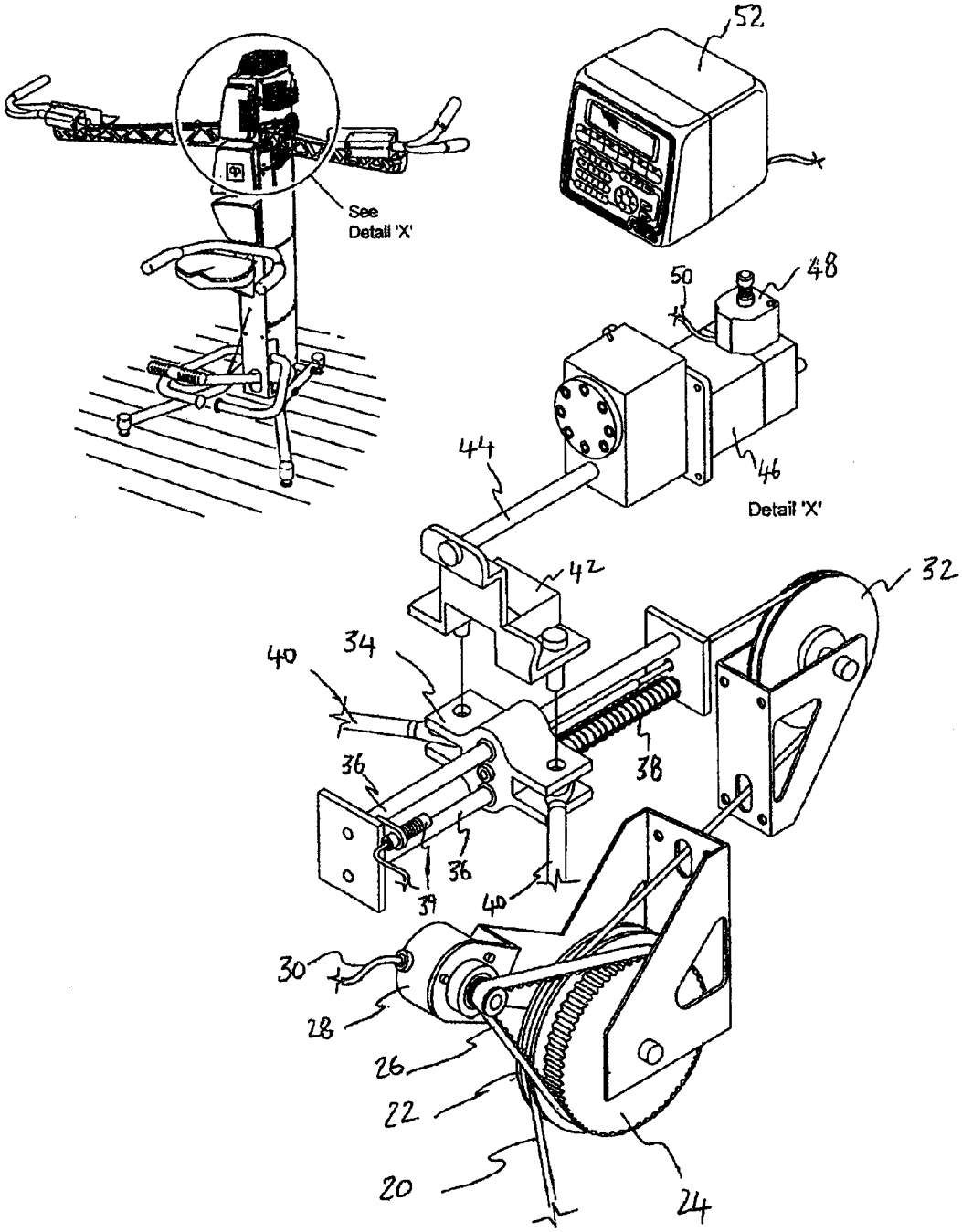
FIG. 5 is an exploded perspective view of a portion of the stretching device.
Figure 6:
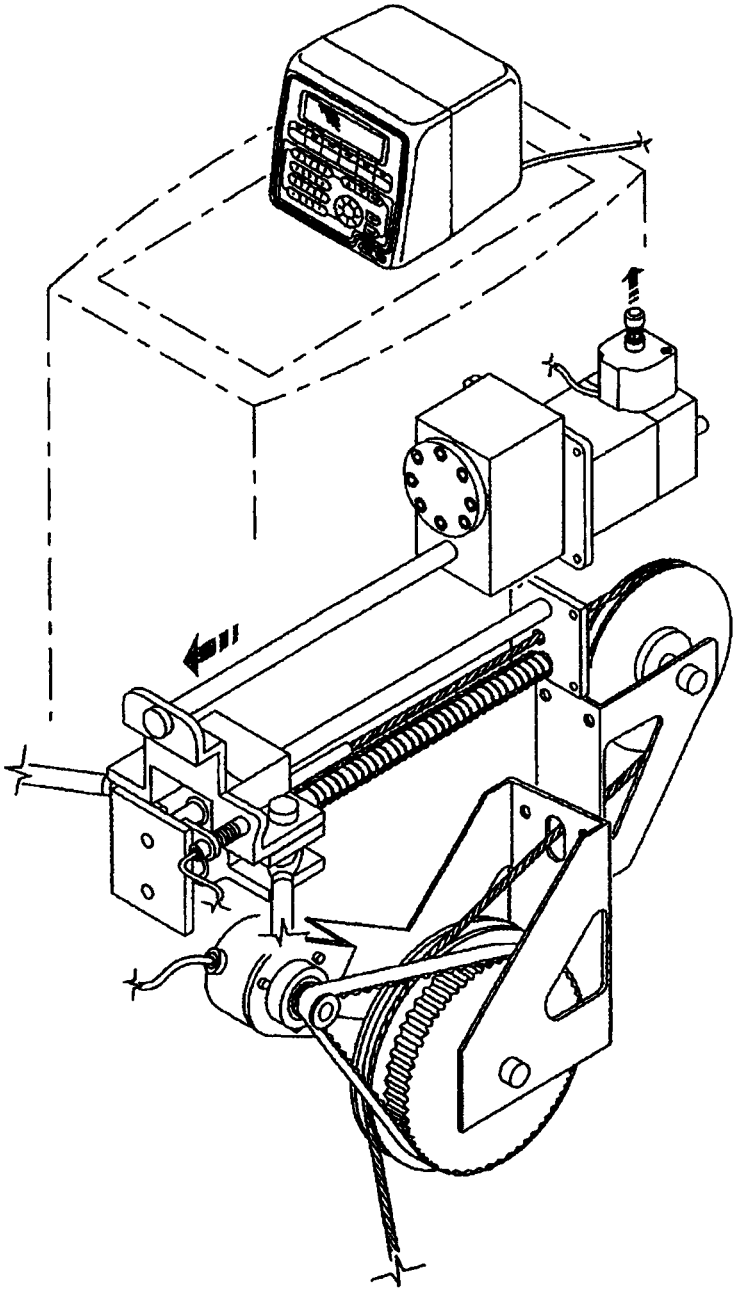
FIG. 6 is an assembled perspective view of a portion of the stretching device, showing the stretching device in the relaxed or non-stretching position.
Figure 7:
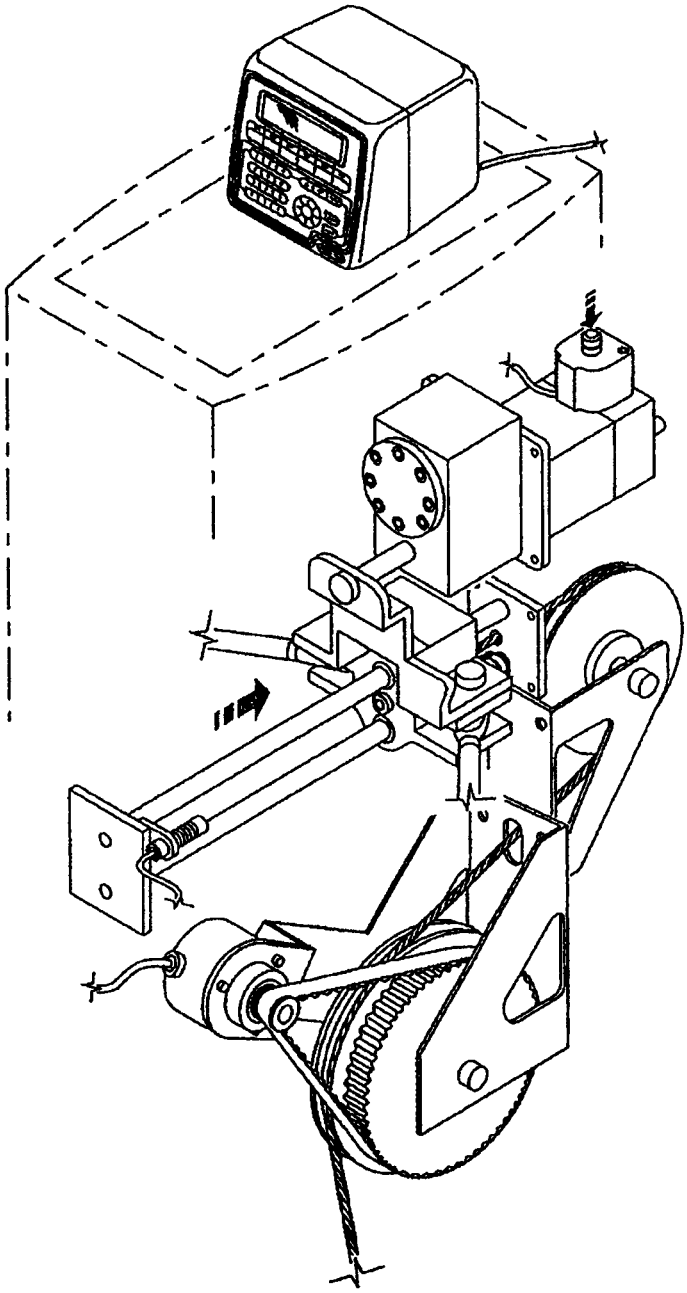
FIG. 7 is an assembled perspective view of a portion of the stretching device, showing the stretching device in the stretching position.
Figure 8:
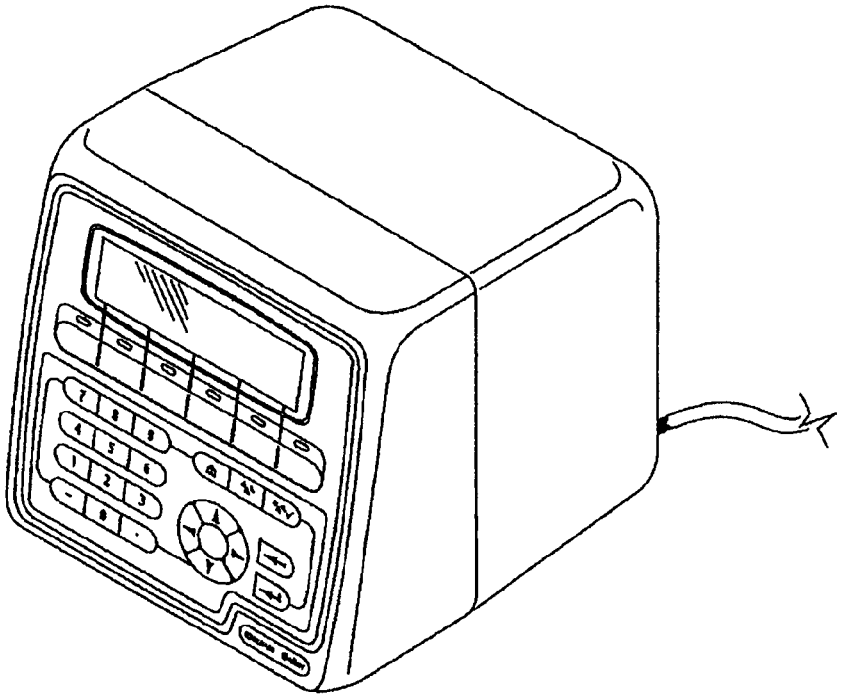
FIG. 8 is a perspective view of the user interface associated with the computer.

A cable 20 is connected to the downwardly pivoting foot bar. Referring to FIGS. 5-7, the cable 20 extends over a first pulley 22. The first pulley 22 rotates in unison with a toothed wheel 24. An endless toothed belt 26 extends between the toothed wheel 24 and the pinion of a rotary encoder 28. The rotary encoder communicates with computer 52 via wire 30. It will be appreciated that this mechanism measures the movement of the cable, this being a proxy for direct measurement of the movement of the swing arms 14. In an alternative embodiment, the rotary encoder(s) may directly measure the angle of the swing arm(s).

After passing over the first pulley 22, the cable 20 extends around a second pulley 32. Ultimately, the cable 20 terminates at a collar 34 which is slidably mounted on a pair of spaced and parallel shafts 36. The collar is resiliently urged towards the relaxed, non-stretching position illustrated in FIG. 6 by a return compression spring 38. Each time that the collar returns to the relaxed, non-stretching position, a re-set switch 39 is engaged. This ensures that the rotary encoder is re-zeroed after every stretching cycle.

Figure 9:
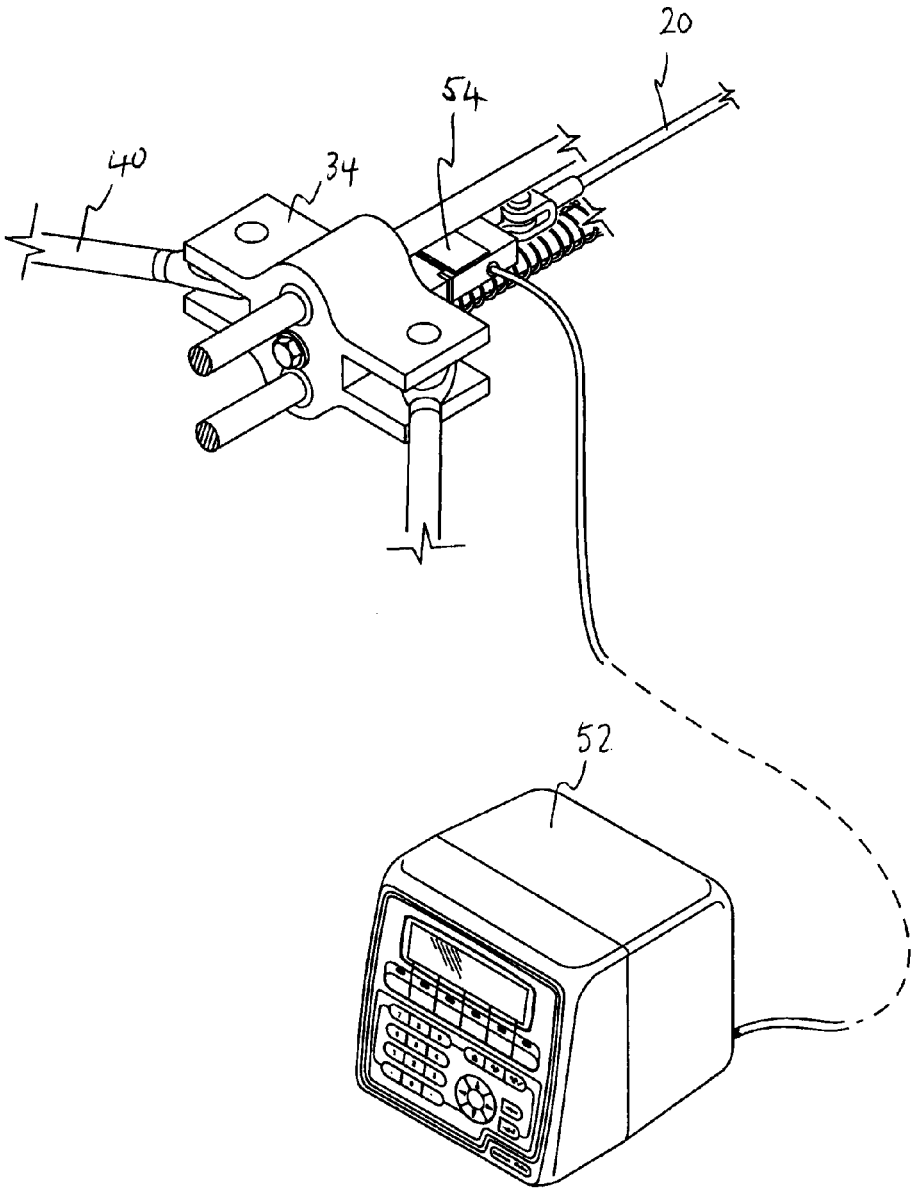
FIG. 9 is a perspective view of the user interface connected to a load cell.

A pair of tie-bars 40 are mounted to the collar 34. The other ends of these tie bars (not illustrated) are attached to the swing arms 14. As can be seen in FIG. 9, a load cell 54 is provided intermediate cable 20 and collar 34. Load cell 54 measures the tensile load in the cable 20 (and hence measures the stretching load) and communicates with computer 52.

It will be appreciated that depression of the foot bar 16 pulls on the cable 20 which, in turn, pulls the collar 34 rearwardly (from the position shown in FIG. 6 to the position shown in FIG. 7) which, in turn, drives the swing arms 14 in the rearward, stretching direction.

Mounted on top of the collar 34 is a bracket 42 which is mounted to the distal end of the piston 44 of a hydraulic damper 46. The damper 46 has a solenoid 48 which communicates with the computer 52 via wire 50.

Computer 52 includes a user interface which can be operated to input security codes and other parameters (e.g. percentage drop/increase required to trigger alarm and/or controller). The computer receives position data from rotary encoder 28. The computer includes a clock and the output of the rotary encoder is sampled at, for example, 1,000 Hz. If the detected velocity of the stretch exceeds some pre-determined allowable maximum, then the computer activates an alarm and/or a controller. If, however, the detected velocity does not exceed the allowable maximum, then the computer stores the maximum detected velocity as a (100%) benchmark velocity. The computer simultaneously stores the benchmark load. When a later detected velocity is more than, say, 10% below the benchmark velocity, and/or a later detected load exceeds a predetermined threshold relative to the benchmark load, then the alarm and/or controller is activated.

In the illustrated embodiment, the controller takes the form of a solenoid 48 which operates to lock the damper against further movement in the stretching direction. It does this by closing the orifice in the hydraulic damper, thereby preventing further flow of fluid. It is noted that the solenoid does not prevent movement back towards the relaxed, start position.

Throughout this specification and the claims, unless the context requires otherwise, the word "comprise" and its variations, such as "comprises" and "comprising," will be understood to imply the inclusion of a stated integer or step or group of integers or steps but not the exclusion of any other integer or step or group of integers or steps.

The reference to any prior art in this specification is not, and should not be taken as an acknowledgement or any form of suggestion that such art forms part of the common general knowledge of the skilled person.

The invention claimed is:

1. A user-powered self-stretching device comprising:

a seat, a pair of pivoting swing arms, and a foot bar, a stretch-velocity detector that detects a stretch-velocity produced by the user during a stretch, and an alarm which is operative in response to a predetermined stretch-velocity condition being detected by the stretch-velocity detector, wherein the user sits on the seat and produces a force on the foot bar that will cause movement of the pair of pivoting swing arms to thereby stretch the upper body of the user.

2. A stretching device as claimed in claim 1, wherein the stretch-velocity detector comprises a stretch-position detector and a sampling clock.

3. A stretching device as claimed in claim 1, wherein the predetermined stretch-velocity condition is a detected stretch-velocity dropping by a predetermined amount relative to a previously detected stretch-velocity.

4. A stretching device as claimed in claim 1, wherein the predetermined stretch-velocity condition is a detected stretch-velocity exceeding a predetermined maximum stretch-velocity.

5. A stretching device of claim 1 wherein:

the stretch-velocity detector detects a first stretch-velocity produced by the user during a first phase of a stretch, and the alarm is operative in response to a predetermined second stretch-velocity condition being detected by the stretch-velocity detector during a subsequent phase of the stretch, wherein the second stretch-velocity condition is calculated from the first stretch-velocity detected during the early phase of the stretch.

6. A user-powered self-stretching device comprising:

a seat, a pair of pivoting swing arms, and a foot bar, a stretch-load detector that detects a stretch-load produced by the user during a stretch, and an alarm which is operative in response to a predetermined stretch-load condition being detected by the stretch-load detector wherein the user sits on the seat and produces a force on the foot bar that will cause movement of the pair of pivoting swing arms to thereby stretch the upper body of the user.

7. A stretching device as claimed in claim 6, wherein the stretch-load detector comprises a load cell and a sampling clock.

8. A stretching device as claimed in claim 6, wherein the predetermined stretch-load condition is a detected stretch-load increasing by a predetermined amount relative to a previously detected stretch-load.

* * * * *